US009080794B2

(12) United States Patent
Longsworth

(10) Patent No.: US 9,080,794 B2
(45) Date of Patent: Jul. 14, 2015

(54) GAS BALANCED CRYOGENIC EXPANSION ENGINE

(75) Inventor: Ralph Longsworth, Allentown, PA (US)

(73) Assignee: SUMITOMO (SHI) CRYOGENICS OF AMERICA, INC., Allentown, PA (US)

( * ) Notice: Subject to any disclaimer, the term of this patent is extended or adjusted under 35 U.S.C. 154(b) by 33 days.

(21) Appl. No.: 13/039,763

(22) Filed: Mar. 3, 2011

(65) Prior Publication Data

US 2011/0219810 A1 Sep. 15, 2011

Related U.S. Application Data

(60) Provisional application No. 61/313,868, filed on Mar. 15, 2010.

(51) Int. Cl.

| | |
|---|---|
| ***F25B 9/00*** | (2006.01) |
| ***F25D 9/00*** | (2006.01) |
| ***F25B 9/14*** | (2006.01) |
| ***F25B 9/06*** | (2006.01) |

(52) U.S. Cl.
CPC .... *F25B 9/14* (2013.01); *F25B 9/06* (2013.01)

(58) Field of Classification Search
USPC ..... 62/6, 403
See application file for complete search history.

(56) References Cited

U.S. PATENT DOCUMENTS

| | | | | |
|---|---|---|---|---|
| 2,607,322 A | | 8/1952 | Collins | |
| 3,045,436 A | | 7/1962 | Gifford, et al. | |
| 3,188,819 A | * | 6/1965 | Hogan | 62/6 |
| 3,188,820 A | * | 6/1965 | Hogan | 62/6 |
| 3,188,821 A | * | 6/1965 | Chellis | 62/6 |
| 3,274,786 A | * | 9/1966 | Hogan et al. | 62/6 |
| 3,438,220 A | | 4/1969 | Collins | |
| 3,613,385 A | * | 10/1971 | Hogan et al. | 62/6 |
| 3,650,118 A | * | 3/1972 | O'Neil | 62/6 |
| 3,708,979 A | * | 1/1973 | Bush et al. | 60/522 |
| 4,372,128 A | | 2/1983 | Sarcia | |

(Continued)

FOREIGN PATENT DOCUMENTS

| | | |
|---|---|---|
| DE | 69412171 | 2/1999 |
| JP | 43-8656 Y1 | 4/1968 |

(Continued)

OTHER PUBLICATIONS

International Search Report and Written Opinion of the International Searching Authority dated Nov. 15, 2011, from corresponding International Application No. PCT/US2011/027666.

(Continued)

*Primary Examiner* — Frantz Jules
*Assistant Examiner* — Joseph Trpisovsky
(74) *Attorney, Agent, or Firm* — Katten Muchin Rosenman LLP

(57) ABSTRACT

An expansion engine operating on a Brayton cycle which is part of a system for producing refrigeration at cryogenic temperatures that includes a compressor, a counter-flow heat exchanger, and a load that may be remote, which is cooled by gas circulating from the engine. The engine has a piston in a cylinder which has nearly the same pressure above and below the piston while it is moving. The piston and valves can be either mechanically or pneumatically actuated and the pressures above and below the piston can be nearly equal by virtue of a regenerator that connects the two spaces or by valves.

13 Claims, 7 Drawing Sheets

(56) References Cited

U.S. PATENT DOCUMENTS

| | | | | |
|---|---|---|---|---|
| 5,092,131 | A | 3/1992 | Hattori et al. | |
| 5,181,383 | A * | 1/1993 | Goto et al. | 62/6 |
| 5,345,769 | A * | 9/1994 | Liepert et al. | 62/6 |
| 5,355,679 | A | 10/1994 | Pierce | |
| 5,361,588 | A | 11/1994 | Asami et al. | |
| 5,481,878 | A * | 1/1996 | Shaowei | 62/6 |
| 5,711,157 | A * | 1/1998 | Ohtani et al. | 62/6 |
| 6,202,421 | B1 | 3/2001 | Maguire et al. | |
| 6,205,791 | B1 | 3/2001 | Smith, Jr. | |
| 6,256,997 | B1 | 7/2001 | Longsworth | |
| 2007/0119188 | A1 | 5/2007 | Xu et al. | |
| 2009/0084116 | A1 * | 4/2009 | Yuan et al. | 62/6 |

FOREIGN PATENT DOCUMENTS

| | | | |
|---|---|---|---|
| JP | 49-75444 | U | 6/1974 |
| JP | 55-057673 | A | 4/1980 |
| JP | 61-159763 | U | 10/1986 |
| WO | 01/02781 | A2 | 1/2001 |

OTHER PUBLICATIONS

International Preliminary Report on Patentability and Written Opinion of the International Searching Authority dated Sep. 27, 2012, from corresponding International Application No. PCT/US2011/027666.

German Office Action dated Apr. 15, 2014 for the Corresponding German Patent Application No. 11 2011 100 912.7.

Japanese Office Action dated Nov. 11, 2014 for the Corresponding Japanese Patent Application No. 2013-500086.

Chinese Office Action dated Mar. 17, 2014 for the Corresponding Chinese Patent Application No. 201180014064.1.

Chinese Office Action dated Jan. 22, 2015 for the Corresponding Chinese Patent Application No. 201180014064.1.

* cited by examiner

GAS BALANCED CRYOGENIC EXPANSION ENGINE

BACKGROUND OF THE INVENTION

1. Field of the Invention

This invention relates to an expansion engine operating on the Brayton cycle to produce refrigeration at cryogenic temperatures.

2. Background Information

A system that operates on the Brayton cycle to produce refrigeration consists of a compressor that supplies gas at a discharge pressure to a counterflow heat exchanger, which admits gas to an expansion space through an inlet valve, expands the gas adiabatically, exhausts the expanded gas (which is colder) through in outlet valve, circulates the cold gas through a load being cooled, then returns the gas through the counterflow heat exchanger to the compressor. U.S. Pat. No. 2,607,322 by S. C. Collins, a pioneer in this field, has a description of the design of an early expansion engine that has been widely used to liquefy helium. The expansion piston is driven in a reciprocating motion by a crank mechanism connected to a fly wheel and generator/motor. The intake valve is opened with the piston at the bottom of the stroke (minimum cold volume) and high pressure gas drives the piston up which causes the fly wheel speed to increase and drive the generator. The intake valve is closed before the piston reaches the top and the gas in the expansion space drops in pressure and temperature. At the top of the stroke the outlet valve opens and gas flows out as the piston is pushed down, driven by the fly wheel as it slows down. Depending on the size of the fly wheel it may continue to drive the generator/motor to output power or it may draw power as it acts as a motor. The inlet and outlet valves are typically driven by cams connected to the fly wheel as shown in U.S. Pat. No. 3,438,220 to S. C. Collins. This patent describes a mechanism, which is different from the earlier patent, that couples the piston to the fly wheel, one which does not put lateral forces on the seals at the warm end of the piston. U.S. Pat. No. 5,355,679 to J. G. Pierce describes an alternate design of the inlet and outlet valves which are similar to the '220 valves in being cam driven and having seals at room temperature. U.S. Pat. No. 5,092,131 to H. Hattori et al describes a Scotch Yoke drive mechanism and cold inlet and outlet valves that are actuated by the reciprocating piston. All of these engines have atmospheric air acting on the warm end of the piston and have been designed primarily to liquefy helium, hydrogen and air. Return gas is near atmospheric pressure and supply pressure is approximately 10 to 15 atmospheres. Compressor input power is typically in the range of 15 to 50 kW. Lower power refrigerators typically operate on the GM, pulse tube, or Stirling cycles. Higher power refrigerators typically operate on the Brayton or Claude cycles using turbo-expanders. U.S. Pat. No. 3,045,436, by W. E. Gifford and H. O. McMahon describes the GM cycle. The lower power refrigerators use regenerator heat exchanges in which the gas flows back and forth through a packed bed, gas never leaving the cold end of the expander. This is in contrast to the Brayton cycle refrigerators that can distribute cold gas to a remote load.

The amount of energy that is recovered by the generator/motor in the '220 Collins type engine is small relative to the compressor power input so mechanical simplicity is often more important than efficiency in many applications. U.S. Pat. No. 6,202,421 by J. F. Maguire et al describes an engine that eliminates the fly wheel and generator/motor by using a hydraulic drive mechanism for the piston. The inlet valve is actuated by a solenoid and the outlet valve is actuated by a solenoid/pneumatic combination. The motivation for the hydraulically driven engine is to provide a small and light engine that can be removably connected to a superconducting magnet to cool it down. The claims cover the removable connection.

U.S. Pat. No. 6,205,791 by J. L. Smith describes an expansion engine that has a free floating piston with working gas (helium) around the piston. Gas pressure above the piston, the warm end, is controlled by valves connected to two buffer volumes, one at a pressure that is at about 75% of the difference between high and low pressure, and the other at about 25% of the pressure difference. Electrically activated inlet, outlet, and buffer valves are timed to open and close so that the piston is driven up and down with a small pressure difference above and below the piston, so very little gas flows through the small clearance between the piston and cylinder. A position sensor in the piston provides a signal that is used to control the timing of opening and closing the four valves. If one thinks of a pulse tube as replacing a solid piston with a gas piston then the same "two buffer volume control" is seen in U.S. Pat. No. 5,481,878 by Zhu Shaowei. FIG. 3 of the '878 Shaowei patent shows the timing of opening and closing the four control valves and FIG. 3 of the '791 Smith patent shows the favorable P-V diagram that can be achieved by good timing of the relationship between piston position and opening and closing of the control valves. The area of the P-V diagram is the work that is produced, and maximum efficiency is achieved by minimizing the amount of gas that is drawn into the expansion space between points 1 and 3 of the '791 FIG. 3 diagram relative to the P-V work, (which equals the refrigeration produced).

The timing of opening and closing the inlet and outlet valves relative to the position of the piston is important to achieve good efficiency. Most of the engines that have been built for liquefying helium have used cam actuated valves similar to those of the '220 Collins patent. The '791 Smith, and '421 Maguire patents show electrically actuated valves. Other mechanisms include a rotary valve on the end of a Scotch Yoke drive shaft as shown in U.S. Pat. No. 5,361,588 by H. Asami et al and a shuttle valve actuated by the piston drive shaft as shown in U.S. Pat. No. 4,372,128 by Sarcia. An example of the multi-ported rotary valve similar to the ones that are described in the present invention is found in U.S. patent application 2007/0119188 by M. Xu et al. U.S. Pat. No. 6,256,997 by R. C. Longsworth describes the use of "O" rings to reduce the vibration associated with the pneumatically actuated piston impacting at the ends of the stroke. This can be applied to the present invention.

It is an object of the present invention to achieve good efficiency with a relatively light weight, compact, and reliable engine. Another objective is to have an engine that can be adapted to cooling a large mass from room temperature to a cryogenic temperature while fully using the compressor output, or optimized to produce refrigeration over a small range of cryogenic temperatures. A final objective is to have a Brayton cycle engine in the same size range as present GM cycle refrigerators so that the cold gas flow from the engine can be used to cool distributed loads.

SUMMARY OF THE INVENTION

The present invention combines features of earlier designs in new ways to achieve good efficiency in relatively simple designs that have a small pressure difference between the warm and cold ends of the piston, a mechanically or pneumatically actuated drive stem, and opening and closing of the inlet and outlet valves that is coordinated with the piston position. In the case of the pneumatically actuated engine, gas flow to the drive stem and the inlet and outlet valve actuators is controlled by a rotary valve that has the timing of opening and closing the valves built into it. A mechanically driven stem can have a rotary valve on the end of the drive shaft that switches gas to the inlet and outlet valve actuators. Either a pneumatically or mechanically actuated drive stem can have a shuttle valve that is shifted by the drive stem to pneumatically actuate the inlet and outlet valves. Pressure at the warm end of the piston, around the drive stem, can be kept close to the pressure at the cold end of the piston, while the piston is moving, by use of check valves connected between the warm end of the piston and the compressor supply and return lines, a regenerator connected between the warm and cold ends, or active valves that use ports in the same rotary or shuttle valves that actuate the inlet and outlet valves.

DESCRIPTIONS OF THE PREFERRED EMBODIMENTS

The five embodiments of this invention that are shown in FIGS. 1 to 5 use the same number and the same diagrammatic representation to identify equivalent parts. Since expansion engines are usually oriented with the cold end down, in order to minimize convective losses in the heat exchanger, the movement of the piston from the cold end toward the warm end is referred to as moving up, thus the piston moves up and down.

Figure 1:
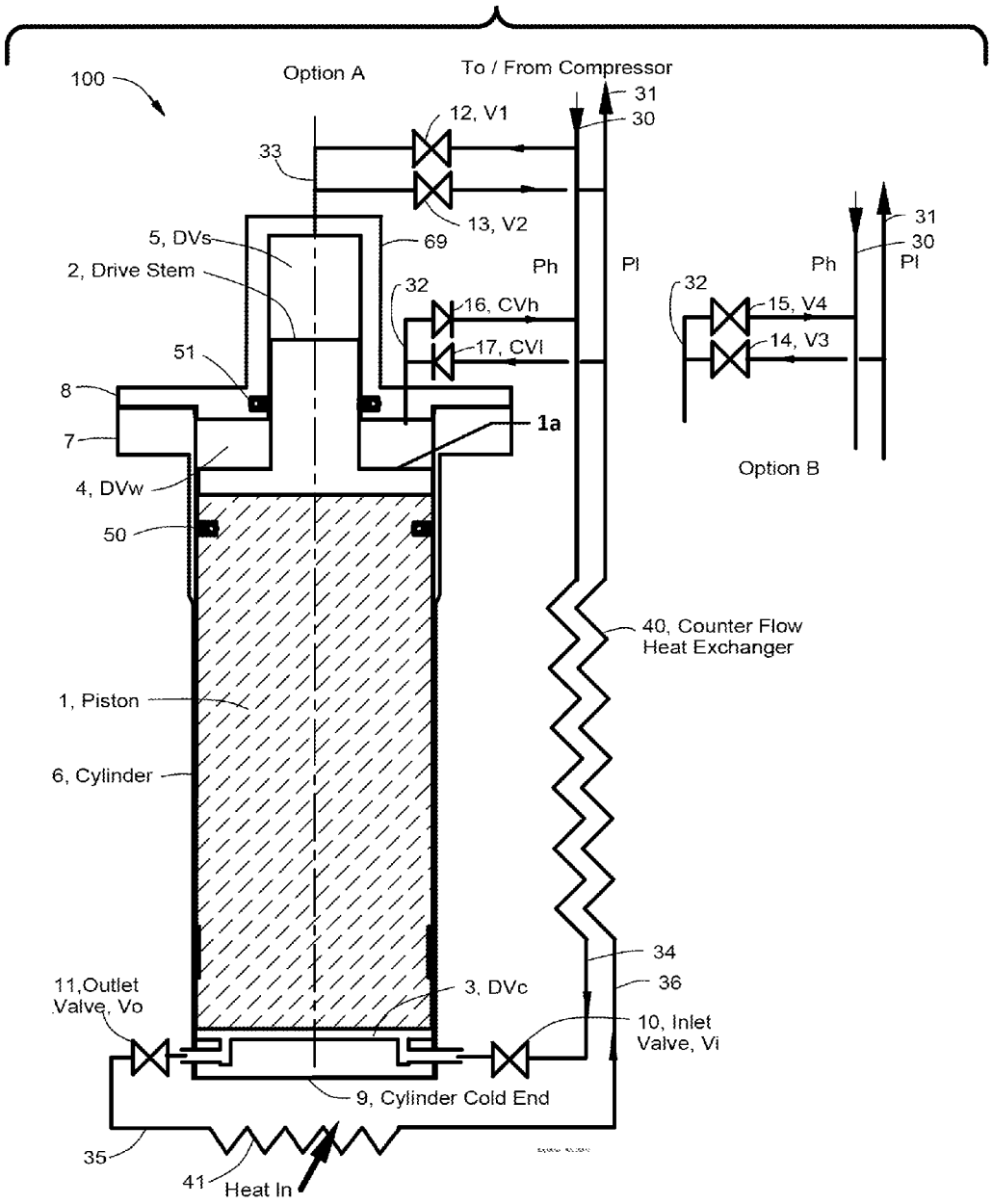
FIG. 1 shows engine 100 which has a piston in a cylinder with a pneumatically driven stem at the warm end, shown in a cross section, and schematic representations of the valves and heat exchangers.

FIG. 1 is a cross section/schematic view of engine assembly 100. An option A and an option B are shown; option A will be described first. Piston 1 reciprocates in cylinder 6 which has a cold end cap 9, warm mounting flange 7, and warm cylinder head 8. Drive stem 2 is attached to piston 1 and reciprocates in drive stem cylinder 69. Piston 1 comprises a piston top surface, e.g., a shoulder 1*a*, outside and/or peripheral of the portion where the drive stem is attached to piston 1. The displaced volume at the cold end, DVc, 3, is separated from the displaced volume at the warm end, DVw, 4, by piston 1 and seal 50. The displaced volume above the drive stem, DVs, 5, is separated from DVw by seal 51. Gas in DVs cycles in pressure from high pressure Ph to low pressure Pl as valves V1, 12, and V2, 13, alternately connect DVs to the high pressure supply line, 30, and the low pressure return line, 31. Refrigeration is produced when inlet valve Vi, 10, is opened with DVc at a minimum, pushing piston 1 up, with DVc at Ph, against balancing pressures in DVw and DVs, then closing Vi, opening Vo, 11, expanding the gas in DVc as it flows out to Pl, cooling as it expands. Gas at Pl is pushed out of DVc as piston 1 moves back towards cold end 9. Cold gas flowing out through Vo passes through line 35 to heat exchanger 41, where it is heated by the load being cooled, then flows through line 36 to counter-flow heat exchanger 40 where it cools incoming gas at Ph, prior to the high pressure gas flowing through line 34 to Vi.

At the time that Vi is opened there is gas at Ph in DVs and gas at P1 in DVw. Admitting high pressure gas to DVc pushes the piston up, increasing the pressure in DVw toward Ph, and DVs to a pressure above Ph until V2 is opened, connecting DVs to P1 through line 33. When the pressure in DVw reaches Ph gas flows out through check valve CVh, 16, to high pressure line 30. In effect work is being done on the gas in DVw, equivalent the work done in the generator of a flywheel drive type engine. The area of the drive stem has to be sufficient for the force balance between Ph, minus the pressure drop in the heat exchanger, on the cold end of the piston to exceed Ph acting on the warm end of the piston in DVw, and P1 acting on the stem, and seal friction, for the piston to move up. The speed at which the piston moves is proportional to the force imbalance. With the piston at the top of the stroke Vi is closed, then Vo is opened and V2 is closed, then V1 is opened. With gas at Ph in DVs and at Pl in DVc, the piston starts to move down, the pressure in DVw drops to Pl, and is maintained at Pl while the piston moves down as gas flows through check valve CV1, 17, from line 31 at Pl. With DVc at a minimum, valve V1 is closed, completing the cycle. In one embodiment of this engine a multi-ported rotary valve contains ports for V1 and V2 and ports that activate lifters, as shown in FIG. 2, that open and close Vi and Vo.

Embodiment 100 is shown with an option B that replaces check valves CVh, 16, and CV1, 17, with active valves V3, 14, and V4, 15. A rotary valve can have ports to implement valves V1, V2, V3, and V4, and to actuate opening and closing Vi and Vo.

Figure 2:
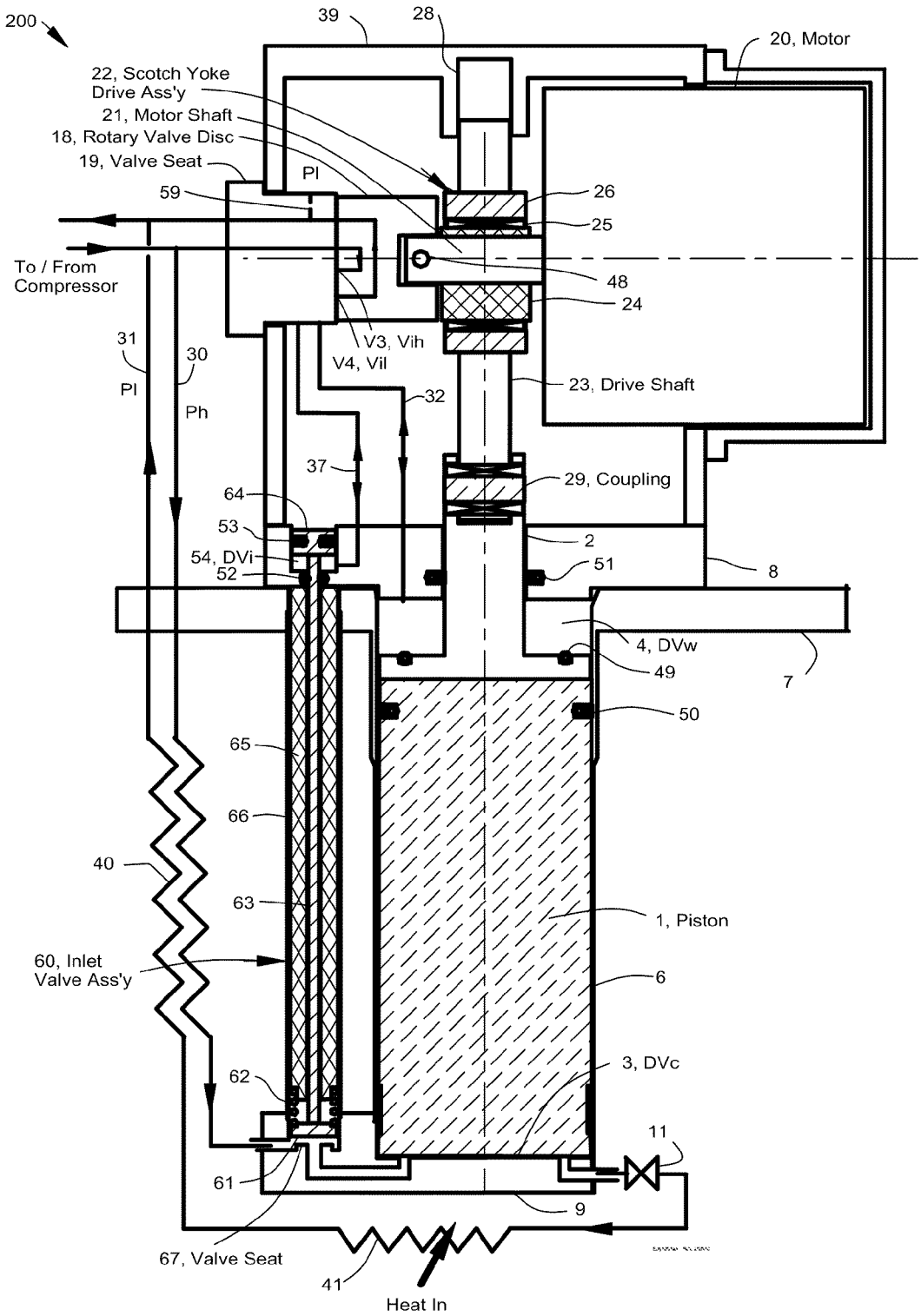
FIG. 2 shows engine 200 which has a piston in a cylinder with a Scotch Yoke mechanism connected to the drive stem at the warm end of the piston, a rotary valve at the end of the drive shaft, and an inlet valve assembly, all shown in cross section. The other valves and heat exchangers are shown schematically.
Figure 4:
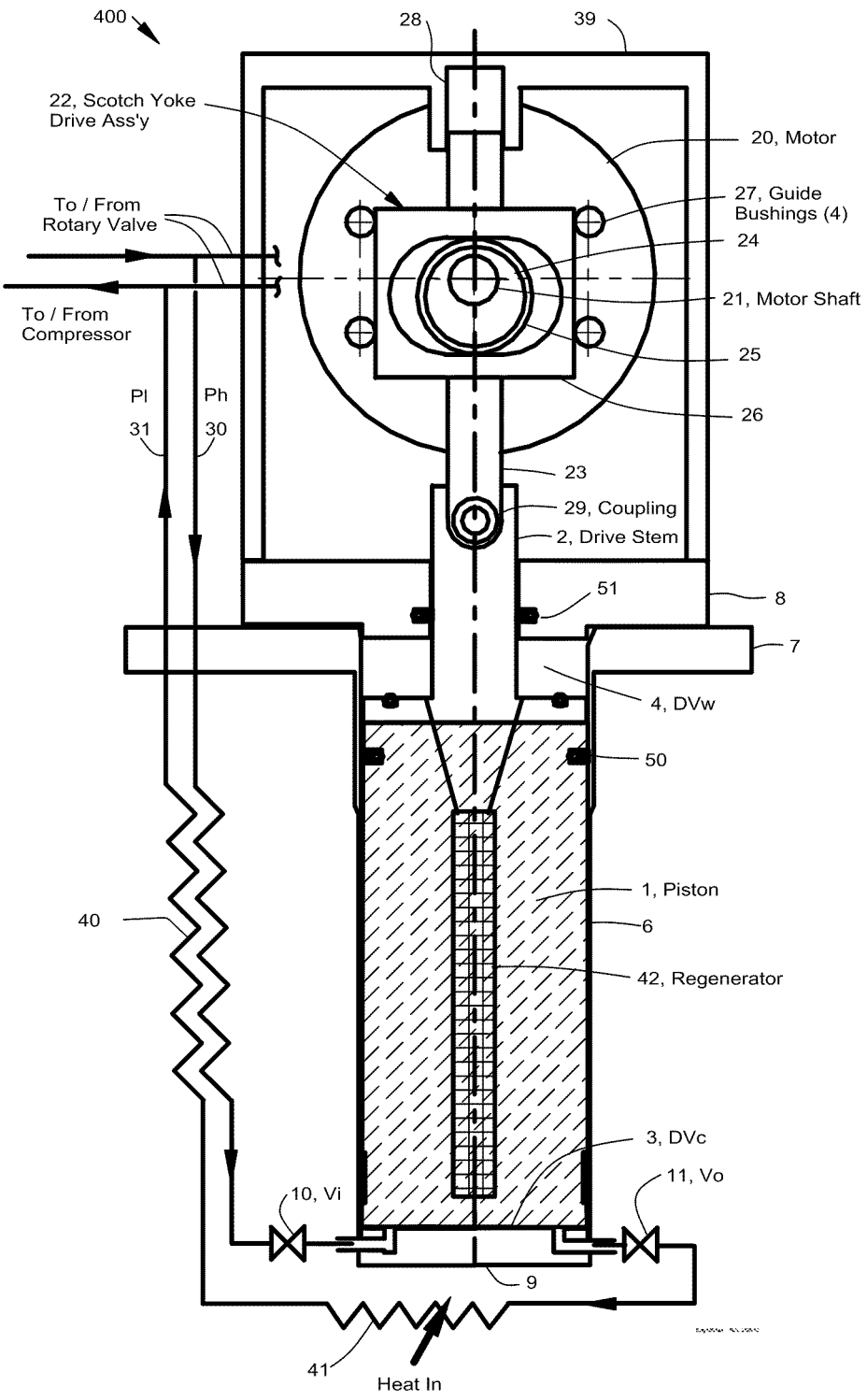
FIG. 4 shows engine 400 which has a piston in a cylinder with a motor driven Scotch Yoke mechanism driving a stem at the warm end the piston, the piston having a regenerator which connects to the warm and cold ends to keep them at about the same pressure, all shown in cross section. The inlet and outlet valves, and the heat exchangers are shown schematically. A rotary valve that switches gas to valve actuators, as shown in FIG. 2, is also part of this assembly.

FIG. 2 is a cross section/schematic view of engine assembly 200. Piston 1, cylinder 6, cold end cap 9, and warm mounting flange 7, are the same as shown in FIG. 1. In this embodiment, drive stem 2 is connected by coupling 29 to drive shaft 23 which reciprocates by virtue of Scotch Yoke drive assembly 22. In addition to components 23 and 29, the drive assembly includes eccentric 24, bearing 25, slotted driver 26, drive shaft guide 28, and bushings 27 that guide the driver. Bushings 27 are shown in FIG. 4 which has a front view of this assembly. Scotch Yoke assembly is driven by motor 20 and motor shaft 21. Shaft 21 also turns rotary valve 18 as coupled by pin 48. Valve disc 18 is held against stationary seat 19 by differential pressure forces similar to those described in U.S. patent application 2007/0119188. FIG. 2 shows a possible construction of inlet valve, Vi, 10, shown schematically in FIG. 1. Outlet valve Vo can have a similar construction. Inlet valve assembly 60 is comprised of poppet 61, spring 62, tension rod 63, valve lifter piston 64, spring holder 65, casing 66, and seat 67. Valve tension rod seal 52, and lifter seal 53, trap gas in displaced volume DVi, 54, which lifts poppet 61 off of seat 67 when gas at Ph is admitted from line 37, and reseats poppet 61 when pressure is switched to Pl by ports Vih and Vil in the interface between rotary valve 18 and seat 19. The force balance on lifter piston 64 assumes gas pressure in housing 39 to be at Pl by virtue of hole 59 in valve seat 19. The interface between disc 18 and seat 19 also contains ports V3, which admits gas at Ph through line 32 to DVw, and V4, which vents gas through the same line at Pl. Outlet valve 11 can be constructed like inlet valve assembly 60 with ports in the rotary valve that actuate the lifter.

Figure 3:
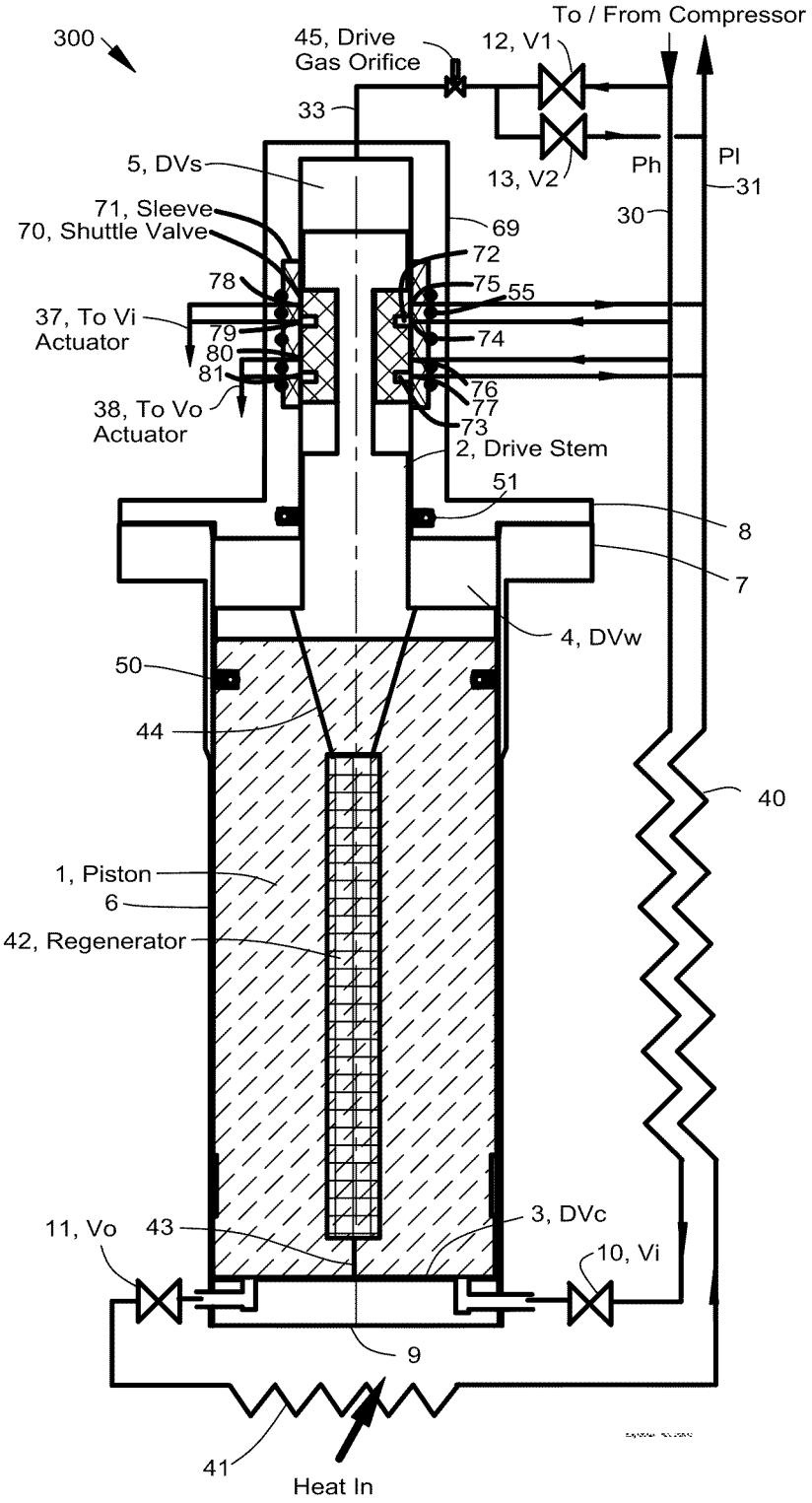
FIG. 3 shows engine 300 which has a piston in a cylinder with a pneumatically driven stem at the warm end with a shuttle valve that switches gas flow to inlet and outlet valve actuators. A regenerator is shown internal to the piston to show a means to keep the warm and cold ends of the piston at about the same pressure, all shown in cross section. The other valves and heat exchangers are shown schematically.

FIG. 3 is a cross section/schematic view of engine assembly 300. Piston 1 has regenerator 42 in its body with hole 43 that connects it to DVc and holes 44 that connect it to DVw. This arrangement allows gas to flow between the two displaced volumes to maintain essentially the same pressure in both. A relatively small volume is needed for the regenerator so losses associated with the regenerator are minimal. The pressure drop through the regenerator is less than the pressure drop through heat exchanger 40 so the pressure difference between DVc and DVw will be less than for embodiments 100 and 200. Piston 1 is driven by gas pressure alternating between Ph and Pl acting on drive stem 2 by virtue of valve V1, 12, which connects DVS, 5, through line 33 to line 30 at Ph, and V2, 13, which connects DVs to line 31 at Pl. Valves Vi and Vo are assumed to be like valve assembly 60 shown in FIG. 2. Valve lifters like 64, in FIG. 2, actuate valves Vi and Vo when gas pressure cycles in lines 37 and 38 between Ph and Pl. Shuttle valve 70 slides in sleeve 71 between the down position, as shown, and an up position when piston 1 is at the top of the stroke. Slots 72 and 73 alternately connect gas at Ph from line 30 and gas at Pl from line 31 to lines 37 and 38 through ports 74, 75, 76, and 77 on the compressor side of valve 70 to lines 37 and 38 through ports 78, 79, 80, and 81 on the engine side of shuttle valve 70. With piston 1 in the down position, gas at Ph flows through port 74, slot 72, and port 79 to line 37 where it causes a lifter to hold Vi open. The lifter for Vo is connected to Pl through 38, 81, 73, and 77 causing Vo to be closed. When V2 opens and connects DVs to low pressure through line 33 and drive gas orifice 45, piston 1 moves up. Shuttle valve 70 does not move until piston 1 almost reaches the top of the stroke and pushes shuttle valve 70 up, so that slots 72 and 73 align with the top ports in sleeve 71 and cause Vi to close and Vo to open. The lifter for Vi is connected to Pl through 37, 78, 72, and 75. The lifter for Vo is connected to Ph through 38, 80, 73, and 76. Switching pressure in DVs from Pl to Ph, by closing V1 and opening V2, causes piston 1 to move down. Shuttle valve 70 does not move until piston 1 almost reaches the bottom. "O" ring 55 is one of a series of "O" rings in drive stem cylinder 69 that seal the circumference of 71 to prevent axial leakage of gas from high to low pressure.

Drive gas orifice 45 can be adjusted manually or electrically to control the speed at which piston 1 moves up and down. If an engine is to be used to cool down a load, and one wants to maintain a constant work out put from the compressor then it is necessary to start out at a maximum engine speed at room temperature and reduce the engine speed as it gets colder. The objective is to adjust orifice 45 so that piston 1 makes a full stroke but does not dwell very long at the ends of the stroke. Alternately it is possible to operate at constant speed with a fixed orifice that is set for operation at minimum temperature. During cool down the compressor will by-pass some gas. FIG. 4 is a cross section/schematic view of engine assembly 400. It has the same feature as engine 300 in having regenerator 42 in the body of piston 1 to minimize the pressure difference between DVc and DVw, and the mechanical drive mechanism of engine 200. Scotch Yoke drive assembly 22 which is shown in side view in FIG. 2 is shown in front view in FIG. 4. Rotary valve disc 18 mounted on the end of motor shaft 21 along with valve seat 19, which are shown in FIG. 2, are part of engine 400 but only 21 is shown in FIG. 4. The same is true of inlet valve assembly 60. A similar valve assembly to open and close Vo is part of engine 400 but not shown. Rotary valve disc 18 and seat 19 have ports for actuating valve lifters through lines 37 and 38 as shown in FIGS. 2 and 3 are also part of engine 400 but not shown in FIG. 4. The front view of Scotch Yoke drive assembly 22 shows motor 20, coupling 29 that connects drive shaft 23 to drive stem 2, eccentric 24, bearing 25, slotted driver 26, drive shaft guide 28, and guide bushings 27. Other components that are shown have been described previously.

Engine 400 is a versatile design because the speed can be varied, the pressure difference between DVc and DVw will always be small regardless of valve timing, and there is latitude in valve timing that can result in high efficiency.

Figure 5:
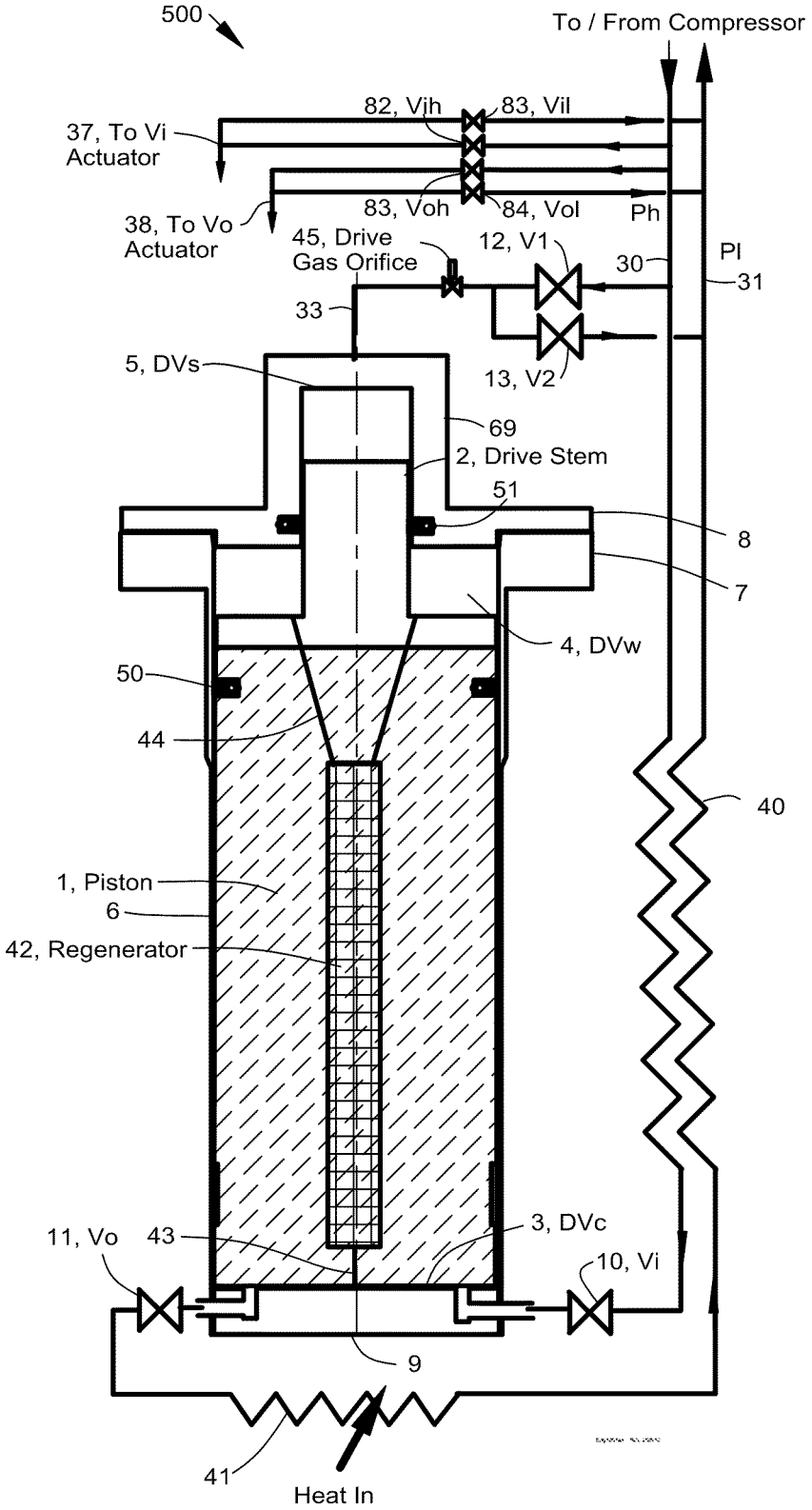
FIG. 5 shows engine 500 which has a piston in a cylinder with a pneumatically driven stem at the warm end and a regenerator internal to the piston which keeps the warm and cold ends of the piston at about the same pressure, all shown in cross section. The other valves and heat exchangers are shown schematically.

FIG. 5 is a cross section/schematic view of engine assembly 500. It has the same feature as engines 300 and 400 in having regenerator 42 in the body of piston 1 to minimize the pressure difference between DVc and DVw. Piston 1 is driven by gas pressure alternating between Ph and Pl acting on drive stem 2 by virtue of valve V1, 12, which connects DVS, 5, through line 33 to line 30 at Ph, and V2, 13, which connects DVs to line 31 at Pl. Valves Vi and Vo are assumed to be like valve assembly 60 shown in FIG. 2. Valve lifters like 64, in FIG. 2, actuate valves Vi and Vo when gas pressure cycles in lines 37 and 38 between Ph and Pl as controlled by valves 81, Vih, 82, Vil, 83, Voh, and 84, Vol. A rotary valve, as shown in FIG. 2, can have ports for V1, V2, Vih, Vil, Voh, and Vol. which have the desired sequence and relative timing built into the disc and seat. Other components that are shown have been described previously.

Figure 6A:
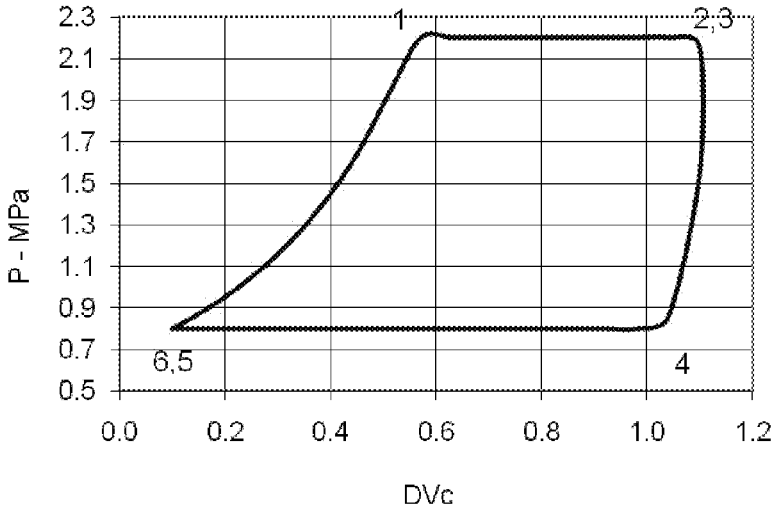
FIG. 6 shows pressure-volume diagrams for one or more of the engines shown in FIGS. 1 to 5.
Figure 6B:
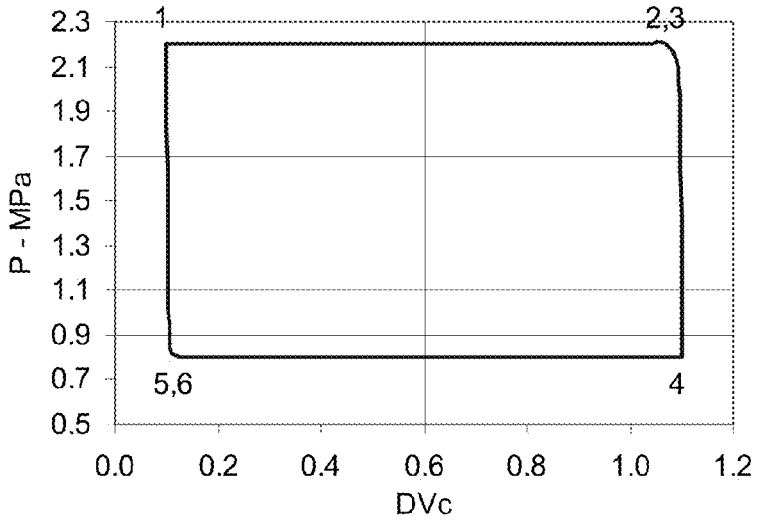
Figure 6C:
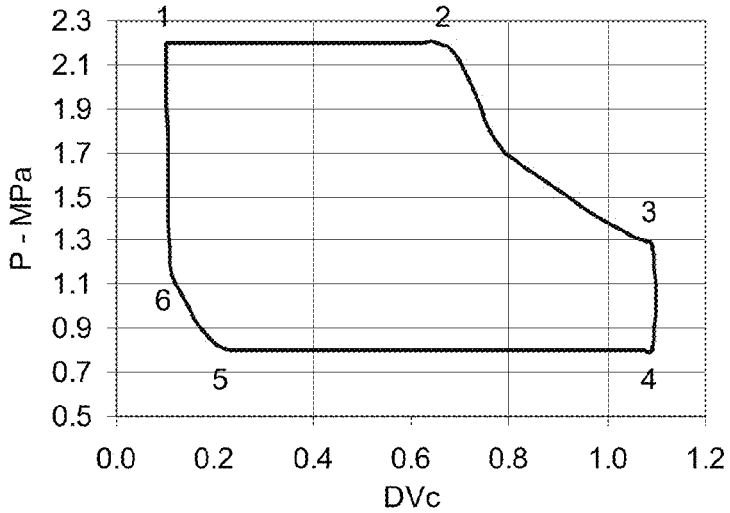
Figure 7:
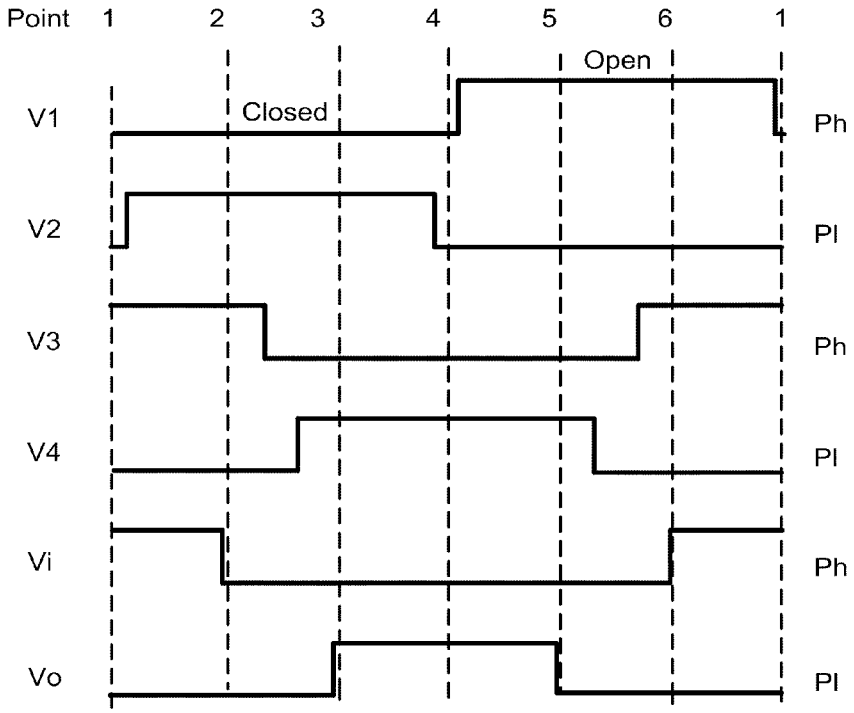
FIG. 7 shows valve opening and closing sequences for the engines shown in FIGS. 1 to 5.

FIG. 6 shows pressure-volume diagrams and FIG. 7 shows valve opening and closing sequences for one or more of the engines shown in FIGS. 1 to 5. The state point numbers on the P-V diagrams correspond to the valve open/close sequence shown in FIG. 7. The timing of the valves opening and closing is not shown, only the sequence. P-V diagram 6*a* applies to engine 100, option A, which has check valves in place of V3 and V4, which are shown in option B. Point 6 represents piston 1 at the end of the stroke, minimum DVc, DVc and DVw at Pl, DVs at Ph. Vo is then closed and Vi opened. DVc increases until the gas in DVw is compressed to Ph, point 1. At point 1 V1 is closed then V2 is opened so the pressure in DVs is at Pl. Piston 1 moves up as gas flows out through CVh to line 30 at Ph. Inlet valve Vi closes at point 2 which is timed to occur when piston 1 is at the top of the stroke, minimum DVw. Vo is then opened, point 3, and the pressure in DVc drops to Pl. Residual gas at Ph in the warm end clearance volumes causes piston 1 to start moving down as V2 is closed and V1 opened, point 4. As gas at Ph in DVs drives the piston down, gas is drawn into DVw at Pl through CV2. When piston 1 reaches the cold end Vo is closed, point 5.

Replacing the check valves in engine 100, option A, with active valves, option B, enables the engine to operate on P-V diagram 6*b*. After the piston reaches the bottom at point 5, V4 closes then V3 opens, changing the pressure in DVw from Pl to Ph. DVs is still at Ph so when Vi is opened, point 6, the piston does not move until V1 is closed and V2 opened at point 1. Gas in DVs at Pl causes the piston to move up, drawing gas at Ph into DVc. Piston 1 reaches the top before Vi is closed at point 2. V3 is then closed and V4 opened before Vo is opened at point 3. The gas pressure in DVs and DVw is actually at slightly below Pl, because of pressure drop in heat exchanger 40, so the piston does not start to move down until V2 is closed and V1 opened at point 4.

Engine 200 also operates on P-V diagram 6*b*. Scotch Yoke drive assembly 22 replaces the stem drive and valves V1 and V2. After the piston reaches the bottom at point 5, Vo closes, V4 then closes, followed in quick succession by V3 and Vi opening at point 6. Gas pressure in DVc reaches Ph as the Scotch Yoke drive starts to move the piston up, point 1. Gas pressure is at Ph until the piston reaches the top and Vi is closed, point 2. V3 is then closed and V4 opened before Vo is opened, point 3. The gas pressure in DVc drops quickly to Pl as piston 1 moves down, starting at point 4.

Engine 300 also operates on P-V diagram 6*b*. The need for valves V3 and V4 is obviated by internal regenerator 42 that keeps DVc and DVw at the same pressure. When piston 1 reaches the bottom, points 5 and 6, Vo closes and Vi opens, pressure in DVs is at Ph, keeping the piston down. With gas at Ph in DVc and DVw, point 6, the piston does not move until V1 is closed and V2 opened at point 1. Gas in DVs at Pl causes the piston to move up, drawing gas at Ph into DVc. When piston 1 reaches the top, shuttle valve 70 shifts to close Vi at point 2, and open Vo, point 3. Gas pressure in DVc drops to Pl then V2 is closed and V1 opened, point 4, causing piston 1 to move down.

Engine 400 operates on P-V diagram 6*c*. It does not have valves V1, V2, V3, or V4. Piston 1 is driven by Scotch Yoke assembly 22, and regenerator 42 equalizes the pressure in DVc and DVw. Before piston 1 reaches the bottom, point 5, Vo closes and the pressure in DVc and DVw increases as piston 1 moves to the cold end, transferring cold gas in DVc to DVw at room temperature. At point 6 Vi is opened and the pressure in DVc and DVw increases rapidly to Ph. At point 1 the piston moves up, drawing gas at Ph into DVc. Before piston 1 reaches the top, Vi closes, point 2, and the gas pressure drops as the piston moves to the top, point 3, transferring warm gas in DVw to DVc. Vo is then opened and gas pressure in DVc drops to Pl. Piston 1 then starts to move down, point 4, and pushes the gas at Pl out through Vo as it moves to point 5.

Engine 500 operates on P-V diagram 5*c*. It does not have valves V3, or V4 because regenerator 42 maintains equal pressures in DVc and DVw. Before piston 1 reaches the bottom, point 5, Vo closes, (Voh, 83, closes and Vol, 84, opens), and the pressure in DVc and DVw increases as piston 1 moves to the cold end, transferring cold gas in DVc to DVw at room temperature. At point 6 Vi is opened, (Vil, 83, closes, and Vih, 82, opens), and the pressure in DVc and DVw increases rapidly to Ph. At point 1 V1 is closed then V2 is opened causing the piston to move up, drawing gas at Ph into DVc. Before piston 1 reaches the top, Vi closes, (Vih closes and Vil opens), point 2, and the gas pressure drops as the piston moves to the top, point 3, transferring warm gas in DVw to DVc. Vo is then opened, (Vol closes and Voh opens), and gas pressure in DVc drops to Pl. At point 4 V2 closes and V1 opens. Piston 1 then starts to move down and pushes the gas at Pl out through Vo as it moves to point 5.

Table 1 provides a comparison of the refrigeration capacities that are calculated for the different engines. Engines 200 and 300 operate on the same cycle as Engine 100 *b* and have only a small increase in capacity because slightly less gas is used in the drive mechanism, so they are not included. All of the engines assume pressures at Vi to be 2.2 MPa and at Vo to be 0.8 MPa. Helium flow rate is 6.0 g/s and includes flow to the drive stem, valve actuators for Vi and Vo, and gas to allow for void volumes including the regenerator. Heat exchanger efficiency is assumed to be 98%. All of the engines are assumed to have variable speed drive and a mechanism to control the speed of the piston, and valve timing to have a full stroke with only a short dwell time at the ends of the stroke. With the exception of engine 400 the engines have been sized to cool down a mass from room temperature to about 30 K assuming a maximum speed when warm of 6 Hz, and decreasing with temperature so the engines use the assumed flow rate at the assumed pressures throughout most of the cool down. Refrigeration cooling capacity, Q, and operating speed, N, are listed for temperatures, T, at Vi of 200 K and 60 K. It is obvious that an engine could be designed to operate at a fixed speed in a narrow temperature range, such as 120 K for cooling a cryopump to capture water vapor. Engine 500 is an example of a design that has been optimized for operation in the temperature range from 30 K to 80 K. It has a smaller diameter, Dp, and a shorter stroke, S, than the others, so it operates at higher speeds in the low temperature range. Such a refrigerator would be designed with a heat exchange having a higher efficiency, e.g. 98.5%. From Table 1 it is seen that engine 100 *a* is least efficient. This is due to the low pressure of the gas in DVw when gas at Ph is admitted at point 1. Engines 100 *a*, 100 *b*, 200, and 300, all have losses associated with admitting gas at Ph until the piston reaches the top, then venting it to Pl. Engines 400 and 500 have the best efficiency because they have early closure of Vi so that gas expands as the piston moves from point 2 to point 3, and early closure of Vo so there is some recompression as the piston moves from point 5 to point 6. Engine efficiency increases as it cools down, and the engine slows down, because a smaller fraction of the gas is used at the warm end. Efficiency is maximum at about 80 K, then drops because the heat exchanger losses dominate.

TABLE 1

Performance comparison

| Engine | 100 a | 100 b | 400 | 500 |
|---|---|---|---|---|
| Drive | Pneu | Pneu | SY | Pneu |
| Dp - mm | 101.4 | 101.4 | 82.4 | 101.4 |
| S - mm | 25.4 | 25.4 | 20 | 25.4 |
| V1, V2 | Rotary | Rotary | Rotary | Rotary |
| V3, V4 | CVs | Rotary | Regen | Regen |
| P-V Fig | 6a | 6b | 6c | 6c |
| Tc - K | 200 | 200 | 200 | 200 |
| N - Hz | 4.4 | 4.5 | 5.7 | 5.8 |
| Q - W | 840 | 1,070 | 560 | 1,220 |
| Tc - K | 60 | 60 | 60 | 60 |
| N - Hz | 1.4 | 1.5 | 4.5 | 2.3 |
| Q - W | 110 | 230 | 335 | 315 |

Other embodiments are within the scope of the following claims. For example inlet valve assembly 60, and an equivalent outlet valve assembly, that are described as being pneumatically actuated, could alternately be electrically actuated, or actuated by cams driven by motor 20.

The invention claimed is:

1. An expansion engine for producing refrigeration at cryogenic temperatures, the expansion engine operating with a high pressure gas supplied from a supply line and returning a low pressure gas to a return line, the expansion engine comprising:

a combined cylinder comprising a piston cylinder and a drive stem cylinder, the combined cylinder having a cylinder cold end in the piston cylinder and a cylinder warm end in the drive stem cylinder;

a piston driven by a drive force and having a top surface, the top surface being a piston warm end, the piston reciprocating in the piston cylinder between the cylinder cold end and the cylinder warm end, a drive stem attached to the piston warm end at the top surface and reciprocating in the drive stem cylinder, the piston having a first operating gas pressure at the cylinder cold end and having a second operating gas pressure above a top surface but not on a top surface of the drive stem;

an inlet valve and an outlet valve connected to the cylinder cold end, the inlet valve admitting the high pressure gas when the piston is near the cylinder cold end and moving up, the outlet valve exhausting the gas to the return line when the piston is near the cylinder warm end and moving down;

a valve assembly comprising one of a first check valve, a second check valve, and a first active valve and a second active valve, the valve assembly for maintaining the first operating gas pressure and the second operating gas pressure at a substantially equivalent pressures while the piston is moving;

wherein the first check valve is directly connected between the cylinder warm end and the supply line to allow flow from the warm end to the supply line and the second check valve is directly connected between the cylinder warm end and the return line to allow flow from the return line to the cylinder warm end; and wherein the first active valve is directly connected between the cylinder warm end and the supply line and the second active valve is directly connected between the cylinder warm end and the return line, the opening and closing of the first active valve and the second active valve being coordinated with a position of the piston.

2. An expansion engine in accordance with claim 1 in which the means to maintain the pressures approximately equal is to connect said warm and cold ends with a gas passage including a regenerator.

3. An expansion engine in accordance with claim 1, wherein said the inlet valve and the outlet valve are opened and closed by a pneumatic force.

4. An expansion engine in accordance with claim 1 in which said inlet and outlet valves are opened and closed by one of an electric actuator and a cam actuator.

5. An expansion engine in accordance with claim 3, wherein a timing of opening and closing the inlet valve and the outlet valve is coordinated with the position of said piston by rotary valve or a shuttle valve.

6. An expansion engine in accordance with claim 1, wherein the drive force is a pneumatic force controlled by a rotary valve, the rotary valve also having ports to actuate the inlet valve and the outlet valve.

7. An expansion engine in accordance with claim 1, wherein the drive force is a pneumatic force controlled by a rotary valve, the rotary valve also comprising ports to flow gas to the piston warm end, said flow coordinated with the flow that actuates the inlet valve and the outlet valve.

8. An expansion engine in accordance with claim 1 in which said mechanically actuated drive stem comprises a Scotch Yoke mechanism and a motor that also turns a rotary valve, said rotary valve having ports to actuate said inlet and outlet valves.

9. An expansion engine in accordance with claim 8 in which said rotary valve also contains ports to flow gas to the warm end of said piston, said flow coordinated with the flow that actuates said inlet and outlet valves.

10. An expansion engine for producing refrigeration at cryogenic temperatures, the expansion engine comprising:

a cylinder having a cylinder cold end and a cylinder warm end;

a piston reciprocating in the cylinder between the cylinder cold end and the cylinder warm end to vary a cold end space in the cylinder at the cylinder cold end and a warm end space in the cylinder at the cylinder warm end, the piston comprising a drive stem attached to a portion of the piston warm end and a shoulder on the piston warm end and peripheral to the portion where the drive stem is attached, the piston having a first operating gas pressure at the cylinder cold end and having a second operating gas pressure on the shoulder; and an inlet valve and an outlet valve connected to the cold end space, the inlet valve admitting a high pressure gas from a supply line when the piston is near the cylinder cold end and moving up, the outlet valve exhausting the gas to a gas return line when the piston is near the cylinder warm end and moving down;

a valve assembly comprising one of a first check valve, a second check valve, and a first active valve and a second active valve, the valve assembly for maintaining the first operating gas pressure and the second operating gas pressure at a substantially equivalent pressures while the piston is moving;

wherein the first check valve is directly connected between the cylinder warm end and the supply line to allow flow from the cylinder warm end to the supply line and the second check valve is directly connected between the cylinder warm end and the return line to allow flow from the return line to the cylinder warm end; and wherein the first active valve is directly connected between the cylinder warm end and the supply line and the second active valve is directly connected between the cylinder warm end and the return line, the opening and closing of the first active valve and the second active valve being coordinated with a position of the piston.

11. An expansion engine in accordance with claim 10, wherein said the inlet valve and the outlet valve are opened and closed by a pneumatic force.

12. An expansion engine for producing refrigeration at cryogenic temperatures, the expansion engine operating with a high pressure gas supplied from a supply line and returning a low pressure gas to a return line, the expansion engine comprising:

a combined cylinder comprising a piston cylinder and a drive stem cylinder, the combined cylinder having a cylinder cold end in the piston cylinder, a cylinder warm end in the piston cylinder, the drive stem cylinder joined immediately to the cylinder warm end;

a piston driven by a drive force and having a top surface, the top surface being a piston warm end, the piston reciprocating in the piston cylinder between the cylinder cold end and the cylinder warm end, a drive stem attached to the piston warm end at the top surface and reciprocating in the drive stem cylinder, the piston having a first operating gas pressure at the cylinder cold end and having a second operating gas pressure above a top surface outside an area of the drive stem but not on a top surface of the drive stem;

an inlet valve and an outlet valve connected to the cylinder cold end, the inlet valve admitting the high pressure gas when the piston is near the cylinder cold end and moving up, the outlet valve exhausting the gas to the return line when the piston is near the cylinder warm end and moving down;

a valve assembly connected to the cylinder warm end, the valve assembly for maintaining the first operating gas pressure and the second operating gas pressure at a substantially equivalent pressures while the piston is moving;

wherein a first valve is directly connected between the cylinder warm end and the supply line to allow flow from the warm end to the supply line and a second valve is directly connected between the cylinder warm end and the return line to allow flow from the return line to the cylinder warm end; and wherein the first valve is open while the piston is moving up and the second valve is open while the piston is moving down.

13. An expansion engine in accordance with claim 12, wherein each of the first valve and the second valve at the warm end are one a check valve and an active valve.

* * * * *